US006119323A

United States Patent [19]

Thōne

[11] Patent Number: 6,119,323

[45] Date of Patent: Sep. 19, 2000

[54] APPARATUS FOR THE DESCALING OF ROLLED METAL STOCK

[75] Inventor: Lothar Thōne, Düsseldorf, Germany

[73] Assignee: SMS Schloemann-Siemag AG, Dusseldorf, Germany

[21] Appl. No.: 09/234,571

[22] Filed: Jan. 21, 1999

[30] Foreign Application Priority Data

Jan. 23, 1998 [DE] Germany ..... 198 02 425

[51] Int. Cl.[7] ..... B21B 45/04

[52] U.S. Cl. ..... 29/81.08; 29/81.06; 29/81.09

[58] Field of Search ..... 29/81.08, 81.09, 29/81.06; 72/40, 39

[56] References Cited

U.S. PATENT DOCUMENTS 3,510,065 5/1970 Gigantino ..... 29/81.08
4,269,052 5/1981 Imai ..... 29/81.08
5,272,798 12/1993 Cole ..... 29/81.08
5,502,881 4/1996 Gaydoul ..... 29/81.08
5,675,880 10/1997 Saikin ..... 29/81.08

*Primary Examiner*—S. Thomas Hughes
*Assistant Examiner*—Anthony L. Green
*Attorney, Agent, or Firm*—Herbert Dubno

[57] ABSTRACT

Structural shapes are descaled with water or air jets from a distributor beam in the form of a tube bundle extending across the path of the structural shape and rotatable to juxtapose a selected nozzle array with the structural shape. The nozzle arrays on the distributor have different nozzle patterns depending upon spray distribution required for the particular structural shape and upon a change in the rolling pattern, the distributor can be rotated about the distributor axis to bring one or another of its arrays into operation.

13 Claims, 3 Drawing Sheets

APPARATUS FOR THE DESCALING OF ROLLED METAL STOCK

FIELD OF THE INVENTION

My present invention relates to an apparatus for the descaling of rolled metal stock, especially structural shapes. More particularly, the invention relates to the descaling of metal stock by directing jets of a fluid, usually air or water, thereagainst.

BACKGROUND OF THE INVENTION

German Patent 1 044 008 describes a descaling apparatus in which a nozzle beam is provided with a multiplicity of nozzles which are trained upon the rolled structural shapes for the descaling thereof with high pressure water jets. The nozzles can be turned on and off in groups.

German patent documents DE 31 46 656 A1 and DE 31 47 878 describe systems for the cooling of flat rolled stock using manifold pipes above and below the rolled product to be cooled and directing jets against the rolled product. The jets are connected by tubes with bores in the pipes, the array of bores and nozzles thus extending over the width of the rolled product. Via flaps, which can lie above the bores, the laminar flow of the cooling water can be matched to the width of the rolled product. DE 31 47 878 has a manifold with a multiplicity of outlet openings which allows groups of bores to be shut down to vary the effective cooling width of the unit. This system uses a fixed outer distributor pipe or manifold and a pipe arranged therein, i.e. an inner pipe, both pipes being provided with guide tubes for delivering the cooling water to the rolled products. The guide tubes of the inner pipe, however, are limited to the edge regions of the cooling width and are used for cooling the wider rolled strip when these additional cooling tubes are necessary.

Especially for the hydraulic descaling of rolled products, usually structural shapes with different cross sectional geometries and dimensions, jet rings are provided and these jet rings can be equipped with jet nozzles. The jet nozzles of individual rings are matched to the cross section of the structural shape to be treated and are replaceable depending upon the structural shape to be treated. Such an arrangement requires that, before any change in the rolling program, there be a reconstruction of the scale scraper by replacement of the jet rings or one of the jet rings. Such an approach is time-consuming and cost-intensive.

OBJECTS OF THE INVENTION

It is the principal object of the present invention to provide an apparatus for the descaling of rolled products, hereinafter referred to as rolled metal stock, especially hot rolled products which may still be at an elevated temperature and most particularly rolled structural shapes, which allows matching of the descaling rapidly and simply to the different geometries and dimensions of the structural shapes upon a variation in the rolling program.

Another object of the invention is to provide a descaling apparatus which avoids the drawbacks detailed above.

It is also an object of the invention to provide a descaling apparatus which is significantly more versatile than earlier systems and can be used for structural shapes of various configurations.

SUMMARY OF THE INVENTION

These objects and others which will become apparent hereinafter are attained, in accordance with the invention, in an apparatus for the descaling of rolled products, especially structural shapes wherein a multiplicity of nozzles are provided, the nozzles having nozzle bodies connected to a manifold and the product being passed between such nozzles or under or along such nozzles. According to the invention the manifold forms part of an assembly of such manifolds which can be rotated to bring a particular nozzle array into play, the nozzles have nozzle bodies communicating with openings in the distributor or manifold and orifices at the ends of such bodies, and the nozzle array is matched to the cross sectional contour of the structural shape displaced past the descaling unit and is itself adjustable.

More particularly, the apparatus for the descaling of rolled model stock can comprise:

- transport means defining a transport path for rolled metal stock to be descaled;
- at least one distributor along the path rotatable about a distributor axis to juxtapose a selected one of a plurality of nozzle arrays with rolled metal stock displaceable along the path, each of the nozzle arrays having generally radial nozzles adapted to be trained on rolled metal stock displaceable along the path to direct jets of descaling fluid against the rolled metal stock, the arrays having different nozzle patterns matching different cross sectional configurations of different kinds of rolled stock to be descaled;
- means for securing the distributor at a selected angular position about the distributor axis so that the selected one of the nozzle arrays is juxtaposed with rolled metal stock displaceable along the path; and
- means for feeding the fluid to at least the selected one of the nozzle arrays at the distributor.

Upon a change in the rolling program which will result in a change in the geometry of the structural shape which is to be descaled, the descaling unit can be reset to the new structural shape geometry and dimensions by rotating the distributor about its axis and arresting it in a new position corresponding to the desired spraying of the workpieces with the water or for the impingement of air jets on the workpiece and in the pattern which has been optimally selected therefor. The change in the configuration of the array can thus be effected quickly and inexpensively since the arrays can be preset in advance for the different geometries and dimensions of the products to be descaled.

The distributor can be a tube bundle assembled from a number of pipes, each of which carries a respective array of nozzles, the arrays being swingable about the respective pipe axes while the distributor is rotatable about the distributor axis to bring the array selectively into play, i.e. juxtaposition with the workpieces passing by the distributor. The lengths of the nozzle bodies may vary depending upon the spray pattern that is desired and the spray pattern is also effected by the number of nozzles, their spacing and their orientations for spray angles.

It has been found to be advantageous to provide each of the pipes individually with a respective coupling element enabling the connection of the source of high pressure water or air to the pipe in the position in which the respective jets are trained on the workpieces. The use of quick-connect couplings for this purpose enables the selected array to be readily supplied with water or air while facilitating changeover between arrays.

Each nozzle array can extend parallel to the distributor axis and can have a length corresponding to the maximum width of the structural shapes to be descaled.

The match of the nozzles to the different cross sectional geometries and dimensions can be effected preferably by selection of longer or shorter nozzle bodies, by varying the number of nozzles in the array and by varying the spacing between the nozzles of the array.

Two such distributors can be provided above and below the path of the rolled stock to be descaled and each can have a multiplicity of manifold pipes, especially four or five, in angular equispaced relationship. Greater numbers of distributors can be provided either above or below or on both sides of the structural shape path. The pipe axes can extend across the path transversely to the direction of displacement of the structural shape and the pipes of each distributor can form a tube or pipe bundle. Each pipe, as already noted, forms a support for a respective nozzle row and when the four pipes are provided on a distributor, the nozzle arrays of the pipes on the distributor are offset by 90° from one another.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
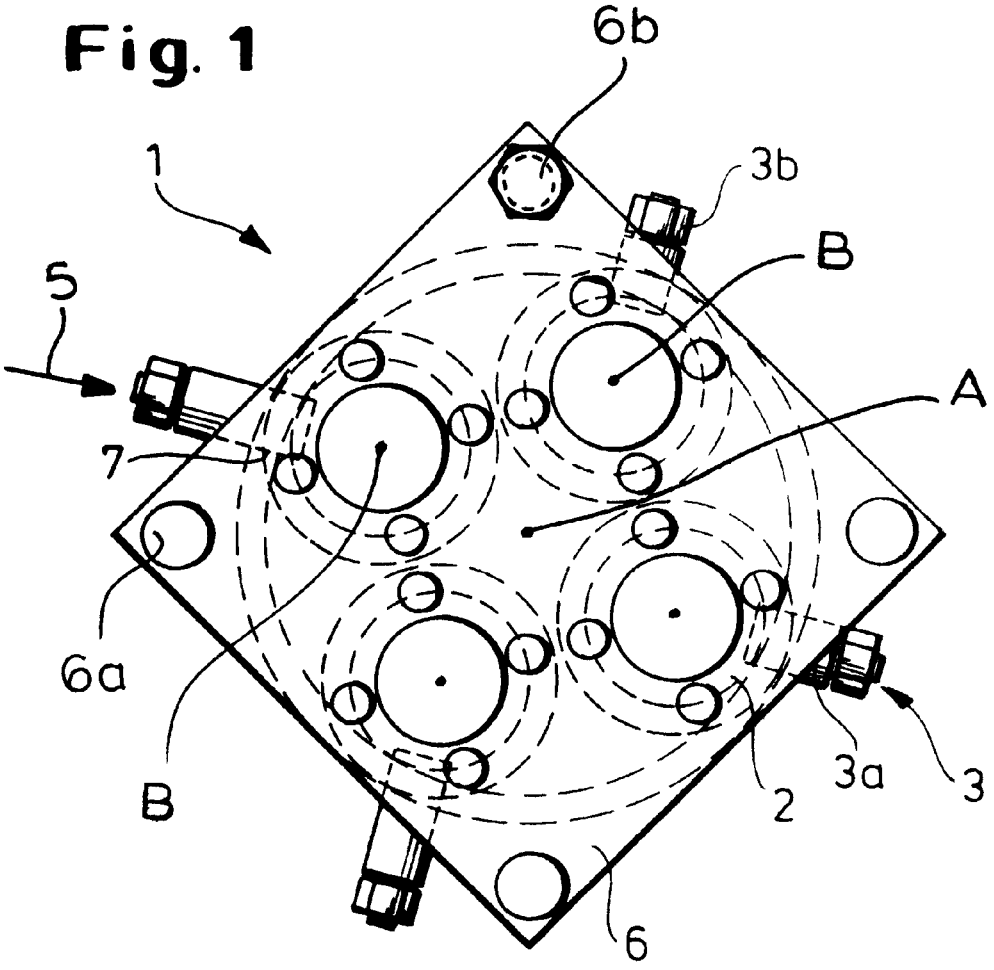
FIG. 1 is an end view of a distributor according to the invention.

FIG. 1 shows a cross section of one possible embodiment of a distributor element 1 which is hereinafter referred to as a spray beam or in some similar terms, which has the overall configuration of a tube bundle and is composed, in this embodiment, of four mutually parallel pipes 2 seen in broken lines, angularly offset at 90° from one another about an axis A of the tube bundle and representing an axis about which the tube bundle can be rotated and fixed in place by bolts passing through holes 6*a* in a support plate 6, one of these bolts being shown at 6*b* in FIG. 1. The bolts can engage in a housing wall 50 (see FIG. 3) of a housing 51 having an outlet 52 from which the sprayed water can drain.

The pipes 2 serve as manifolds to deliver the descaling medium, here water, to the nozzles 3 from which jets are trained upon the rolled stock 4 (see FIG. 3), usually structural shapes or profiles 4.

By rotation of the spray beam or tube bundle 1 about its axis A, one or another of the nozzle arrays or rows 5 can be juxtaposed with the workpiece to be descaled. As can be seen from FIG. 3, each of the arrays 5 of nozzles consists of a row of nozzles 3 having tube segments 3*a* of different lengths terminating in nozzle orifices 3*b*. The length L of the array may correspond to the maximum width of a rolled shape 4 to be descaled in the apparatus and the lengths of the segments 3*a*, the spacing of the segments from one another and the orientations of the segments on the tube 2 will determine the spray pattern which is matched to the geometry of the structural shape to be descaled. When there is a change in the rolling program to alter the geometry of the structural shape being descaled, another array 5 of nozzles, matched to that shape, is rotated into position and the beam is bolted in place.

The pipes 2 terminate in the plate 6 which functions to stabilize the beam or tube bundle and in FIG. 1, for each of the arrays of nozzles 5, only a single nozzle 3 is visible.

The nozzles are all fixed to the pipes 2 at holes or bores 5 formed in these pipes. The bores, shown at 7 in FIG. 1, may be internally threaded on the pipe segments 3*a* and can be threaded externally to be screwed into the bores 7.

Figure 3:
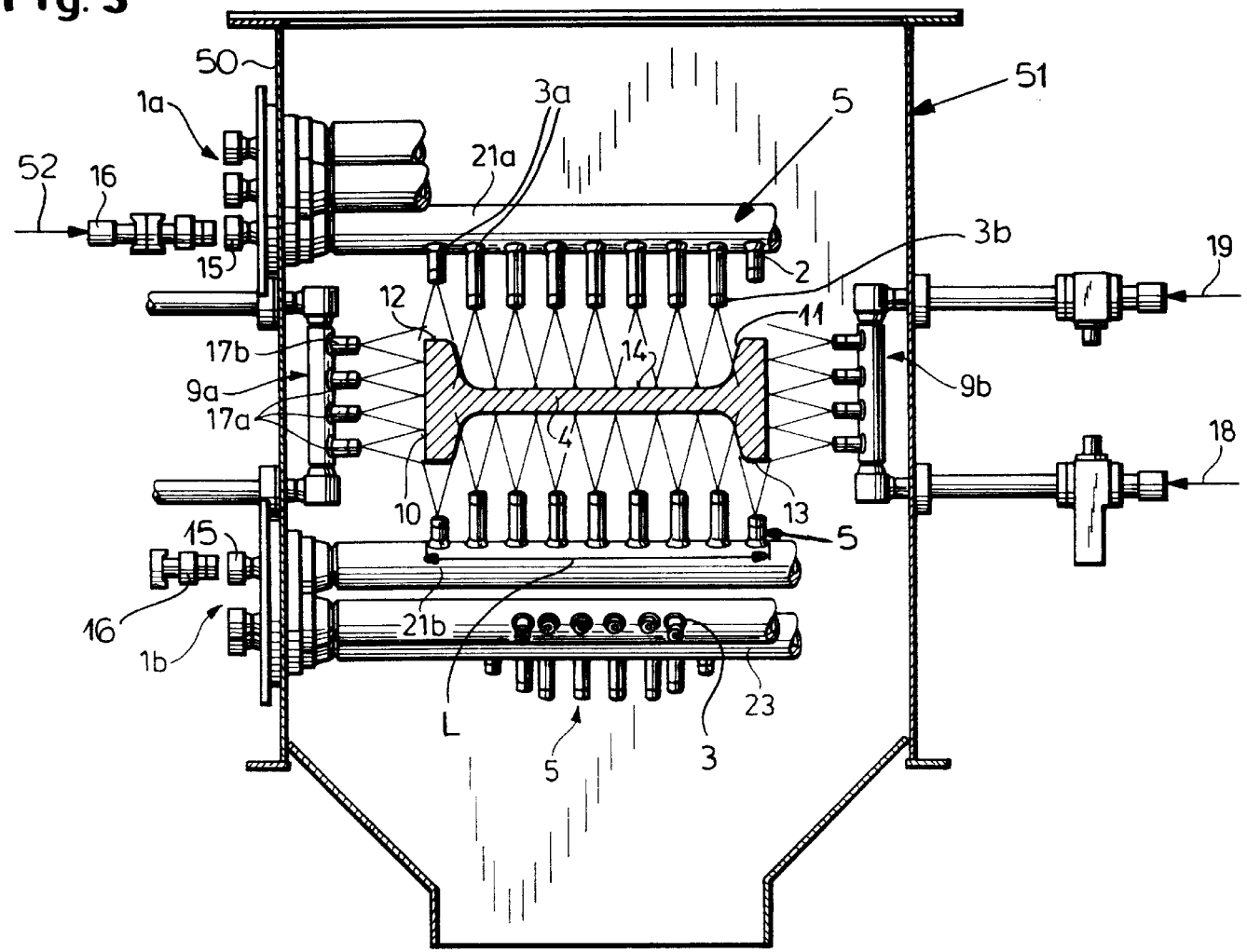
FIG. 3 is a cross sectional view taken in a plane perpendicular to the plane of FIG. 2 and perpendicular to the direction of displacement of the structural shapes to be descaled.

Although that may not be apparent from FIGS. 1 and 3, the angular orientation of the nozzles 3 relative to one another along the array and hence the angle of attack of the respective jets on the workpiece may be varied from array to array as well. The angular orientation may be changed by rotating the pipes about their respective axes as well.

Figure 2:
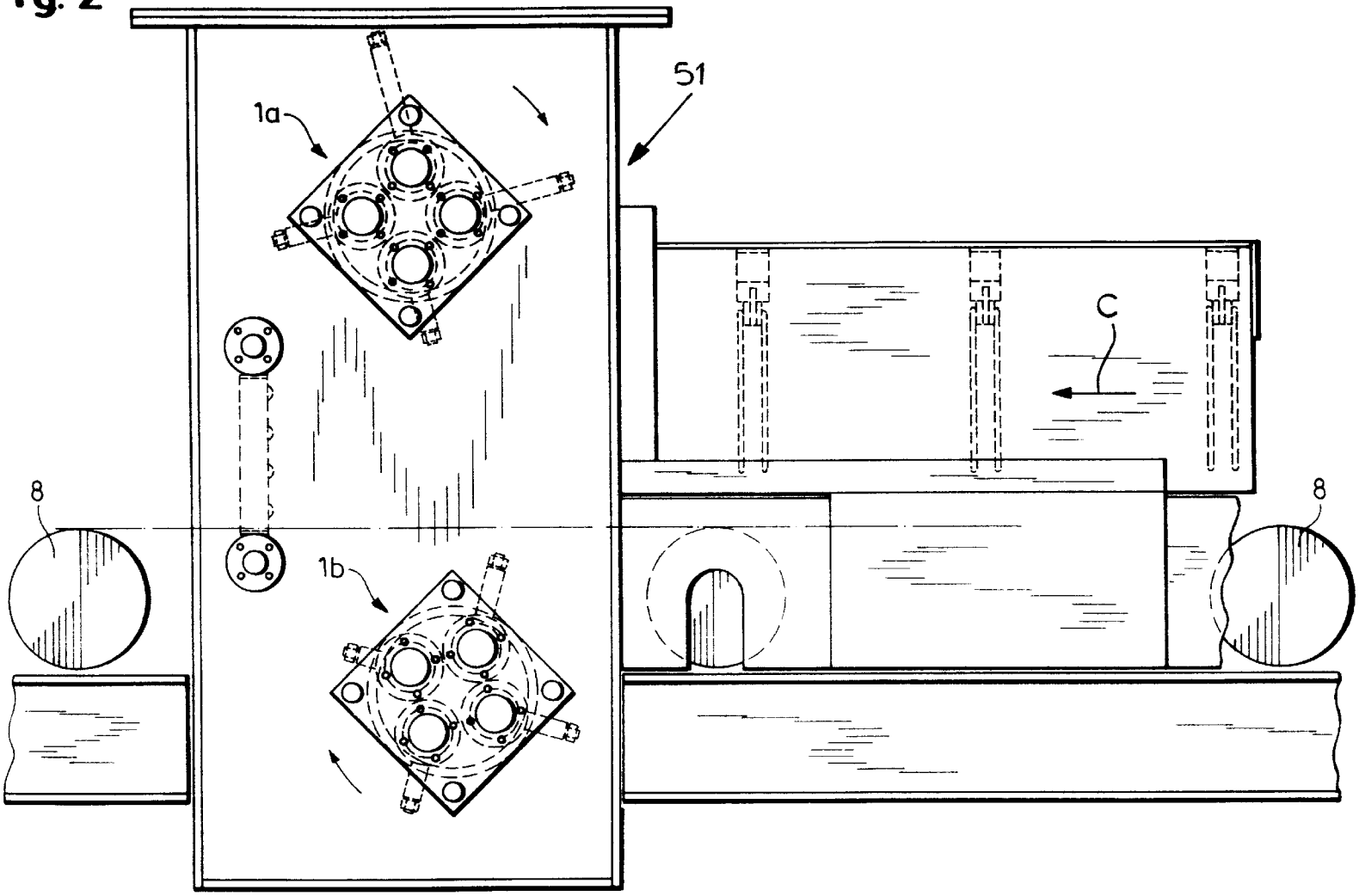
FIG. 2 is a side view through a descaling apparatus having two distributors disposed on opposite sides of the descaling path.

FIG. 2 shows the descaling apparatus in greater detail and from this Figure it will be apparent that at the descaling station represented by the housing 51, two spray beams 1*a* and 1*b* are mounted, the beam 1*a* above the path of the workpieces and the beam 1*b* below the path of the structural shapes 4. The rolled structural shapes can be transported through the descaler on a roller conveyor, the rolls of which have been shown at 8.

FIG. 3 represents a view facing in the direction of the oncoming structural shapes 4, the latter being double-T beams or I-beams whose web surfaces 14 are descaled by the nozzle arrays of the two pipes 21*a* and 21*b* of the beams 1*a* and 1*b* shown in this Figure. In addition, two spray devices 9*a* and 9*b* are provided to direct jets of high-pressure water against the chord surfaces 10 of the upper and lower chords 12 and 13 of the beam 4. The inner surfaces 11 of the chords 12 and 13 are descaled by the jets from the nozzle arrays 5 of the pipes 21*a* and 21*b*.

As is also apparent from FIG. 3, quick-connect couplings can connect a high-pressure water source 52 with the female quick-connect coupling member 15 of the pipe 21*a* juxtaposed with the workpiece 4, a similar quick-connect coupling 16 being engageable with the female coupling member 15 of the pipe 21*b*.

Upon a change in the rolling program, the quick-connect couplings are separated and the beam rotated into a new position. The pipes 21*a* and 21*b* may be rotated about their respective axes to adjust the angles of attack of the nozzles upon the workpiece. Normally, when four pipes 2, 21*a*, 21*b*, 23 are provided in each tube bundle or spray beam, the pipes are angularly spaced about the axis A with their axes 90 offset from one another and the pipe arrays 5 are offset about the pipe axes by 90° from one another (see FIG. 1). The pipe axes are represented at B in FIG. 1 and likewise are perpendicular to the plane of the paper.

From FIG. 3 it will be apparent that the nozzles 3 can be spaced apart with different spacings from one array to the other and even with different spacings within an array (see especially the array of pipe 23). The spray arrangements 9*a* and 9*b* can be supplied with water under high pressure at 18 and 19 and have spray nozzles 17*a* and 17*b*.

Of course each distributor 1, 1*a*, 1*b* can have less than or more than four pipes and, while the distributors extend across the path of the structural shapes 14 (see the arrow C in FIG. 2), they may be oriented at other angles to that path.

I claim:

1. An apparatus for the descaling of rolled metal stock, comprising:

transport means defining a transport path for rolled metal stock to be descaled;

at least one axially extending distributor along said path rotatable about a distributor axis transverse to said path to juxtapose a selected one of a plurality of nozzle arrays entending parrallel to said axis with rolled metal stock displaceable along said path, each of said nozzle arrays having generally radial nozzles spaced along the respective array and adapted to be trained on rolled metal stock displaceable along said path to direct jets of descaling fluid against the rolled metal stock, said arrays having different nozzle patterns matching different cross sectional configurations of different kinds of rolled stock to be descaled;

means for securing said distributor at a selected angular position about said distributor axis so that said selected one of said nozzle arrays is juxtaposed with rolled metal stock displaceable along said path; and means for feeding said fluid to at least said selected one of said nozzle arrays at said distributor.

2. The apparatus defined in claim 1 wherein said distributor includes a respective pipe for each array, said pipes forming a pipe bundle extending across said path, each pipe having openings spaced therealong and communicating with the respective nozzles, said means for feeding including means for supplying each of said pipes individually with said fluid.

3. The apparatus defined in claim 2 wherein each of said pipes has a respective connector for connecting the respective pipe to a source of said fluid.

4. The apparatus defined in claim 1 wherein each of said nozzle arrays includes a row of nozzles of a length corresponding to a maximum width of the rolled stock to be descaled, each array having a respective spray pattern matched to the kind of rolled stock to be descaled by the array with a respective number of nozzles, nozzle spacings and radial lengths of respective nozzle bodies.

5. The apparatus defined in claim 4 wherein a respective one of said distributors is provided above and below said path and each of said distributors comprises four pipes angularly equispaced about the respective distributor axis, each of said pipes being provided with a respective one of said nozzle arrays, said pipes of forming a pipe bundle extending across said path, each pipe having openings spaced therealong and communicating with the respective nozzles, said nozzle arrays of the respective distributor being angularly offset relative to one another and extending parallel to respective pipe axes.

6. The apparatus defined in claim 5 wherein each of said pipes has a respective connector for connecting the respective pipe to a source of said fluid.

7. The apparatus defined in claim 6 wherein said source is a source of water.

8. The apparatus defined in claim 6 wherein said source is a source of compressed air.

9. The apparatus defined in claim 1 wherein a respective one of said distributors is provided above and below said path and each of said distributors comprises four pipes angularly equispaced about the respective distributor axis, each of said pipes being provided with a respective one of said nozzle arrays, said pipes of forming a pipe bundle extending across said path, each pipe having openings spaced therealong and communicating with the respective nozzles, said nozzle arrays of the respective distributor being angularly offset relative to one another and extending parallel to respective pipe axes.

10. The apparatus defined in claim 1 wherein each of said pipes has a respective connector for connecting the respective pipe to a source of said fluid.

11. The apparatus defined in claim 1 wherein said source is a source of water.

12. The apparatus defined in claim 1 wherein said source is a source of compressed air.

13. The apparatus defined in claim 1 wherein each of said arrays is rotatable about an array axis parallel to said distributor axis.

* * * * *